US011357368B1

(12) United States Patent
Olsen

(10) Patent No.: US 11,357,368 B1
(45) Date of Patent: Jun. 14, 2022

(54) SPLASH GUARD TOILET RISER

(71) Applicant: Linda Aileen Olsen, Casper, WY (US)

(72) Inventor: Linda Aileen Olsen, Casper, WY (US)

(73) Assignee: Linda Olsen, Casper, WY (US)

( * ) Notice: Subject to any disclaimer, the term of this patent is extended or adjusted under 35 U.S.C. 154(b) by 0 days.

(21) Appl. No.: 17/169,216

(22) Filed: Feb. 5, 2021

(51) Int. Cl.
*A47K 13/24* (2006.01)

(52) U.S. Cl.
CPC ..... *A47K 13/24* (2013.01)

(58) Field of Classification Search
CPC ..... A47K 13/24
USPC ..... 4/300.3, 415
See application file for complete search history.

(56) References Cited

U.S. PATENT DOCUMENTS 2,698,440 A * 1/1955 Lyons ..... A47K 17/028 4/254
2,790,182 A * 4/1957 Malin ..... A47K 13/28 4/237
2,980,922 A * 4/1961 Taylor ..... A47K 13/005 4/235
3,086,223 A * 4/1963 Gass ..... A47K 13/28 4/237
3,364,505 A * 1/1968 Palmier ..... A47K 13/28 4/239
3,594,831 A * 7/1971 Brewer ..... A47K 17/026 4/237
3,971,077 A * 7/1976 O'Neil ..... A47K 13/28 4/239
4,185,335 A * 1/1980 Alvis ..... A61G 7/1017 4/667
4,187,561 A * 2/1980 Bogan ..... A47K 11/02 4/449
4,214,323 A * 7/1980 Thomas ..... A47K 13/005 297/253
4,462,122 A * 7/1984 Broeils ..... A47K 13/005 4/235
D281,997 S * 12/1985 DiVito ..... D23/311
D290,035 S * 5/1987 Mann ..... D23/311
D307,048 S * 4/1990 Spiegel ..... D23/311
4,993,085 A 2/1991 Gibbons
5,199,112 A * 4/1993 Locarno ..... A47K 13/005 4/237
D345,008 S * 3/1994 Ahlstrom ..... D23/311
5,311,617 A * 5/1994 Ammatelli ..... A47K 13/00 4/237
5,666,673 A 9/1997 Ammatelli et al.
D390,931 S * 2/1998 Jackson ..... D23/311
5,860,169 A * 1/1999 Machanic ..... A47K 17/026 4/237
5,983,415 A * 11/1999 Bogan ..... A47K 11/02 4/449
7,087,041 B2 * 8/2006 von Dyck ..... A61F 5/442 604/332
7,093,308 B2 * 8/2006 Berlovan ..... A47K 13/005 4/235
9,551,139 B2 * 1/2017 Todd, IV ..... E03D 9/00
(Continued)

*Primary Examiner* — Lori L Baker
(74) *Attorney, Agent, or Firm* — Peter J Timbers

(57) ABSTRACT

A splash guard toilet riser apparatus having a wall having a front portion has a concave indentation to reduce splash during toilet use. The splash guard toilet riser has a rear wall with a depressed elevation to allow for access to clean a toilet riser user. The splash guard toilet riser constructed of foam material and adapted to sit atop a toilet during use of a toilet.

19 Claims, 6 Drawing Sheets

(56) References Cited

U.S. PATENT DOCUMENTS

| | | | | |
|---|---|---|---|---|
| 10,076,215 | B1 * | 9/2018 | Quay | A47K 3/26 |
| 2004/0025234 | A1 * | 2/2004 | Moser | A47K 13/005 4/237 |
| 2004/0154085 | A1 * | 8/2004 | Berlovan | A47K 13/005 4/237 |
| 2010/0263115 | A1 * | 10/2010 | Thom | A47K 13/005 4/300.3 |
| 2011/0289671 | A1 * | 12/2011 | Westrick | A47K 11/02 4/476 |
| 2014/0230142 | A1 * | 8/2014 | Baker | A61G 7/1007 4/667 |
| 2016/0108609 | A1 * | 4/2016 | Escudero | A47K 13/24 4/300.3 |
| 2019/0382993 | A1 * | 12/2019 | Gastin | E03D 11/16 |
| 2021/0238837 | A1 * | 8/2021 | Burton | E03D 11/13 |
| 2021/0244584 | A1 * | 8/2021 | Masters | A47C 16/02 |

* cited by examiner

SPLASH GUARD TOILET RISER

FIELD OF THE INVENTION

The present invention relates to a toilet riser that provides a reduction in embarrassing splash from a toilet bodily functions and provides an access for a caregiver to easily provide toilet care to an individual seated on the toilet riser.

BACKGROUND OF THE INVENTION

Toilet riser and toilet seats typically fail to provide adequate splash guard protection for user and health care providers during toilet functions. Toilet mishaps are the result of poor design and poorly functioning mechanisms that allow for urine and toilet water to splash onto toilet users and their caregivers. Additionally, toilet risers often fail to provide crucial access for caregivers as they clean toilet riser users. There exists a long felt need for a toilet riser apparatus to provide a splash guard and back access to the user of the toilet riser.

SUMMARY OF THE INVENTION

Accordingly, it is an object of embodiments of the present invention to provide for a splash guard toilet riser apparatus. Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims. To achieve the foregoing and other objects, and in accordance with the purposes of the present invention, as embodied and broadly described herein, the invention comprises a splash guard toilet riser apparatus comprising a wall having: an inner perimeter surface wall; an outer perimeter surface wall; a top portion; a bottom portion; a front portion; a back portion; a first side portion; a second side portion; a lip; and a void space; the first side portion opposes the second side portion, the first side portion and the second side portions are disposed between the front portion and the back portion; the void space is disposed between the first side portion and the second side portion and the void space is disposed between the front portion and the back portion; the back portion comprises a depressed elevation of the wall; the front portion comprises a concave indentation into the inner perimeter surface wall; and the lip attached to and extending below the bottom portion of the wall. In other embodiments of the instant invention there exists a multiplicity of cavities disposed between the outer perimeter surface wall and the inner perimeter surface wall and the multiplicity of cavities extend from the bottom portion of the wall toward the top portion of the wall.

In another embodiment of the instant invention, the apparatus comprises a foam material. In still other embodiments the foam material is selected from the group consisting of EVA foam 70-90 Shore A and EVA foam 40-60 Shore A.

Benefits and advantages of the present invention include, but are not limited to, providing a splash guard toilet riser that contains bodily waste materials inside the toilet and splash guard toilet riser. Such containment reduces cleanup time and energy. Further the splash guard toilet riser provides access for a care provider to the backside region of one seated on the splash guard toilet riser and the splash guard toilet riser reduces embarrassing wetness on the person seated on the toilet and their clothes.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION AND DRAWINGS

Figure 1:
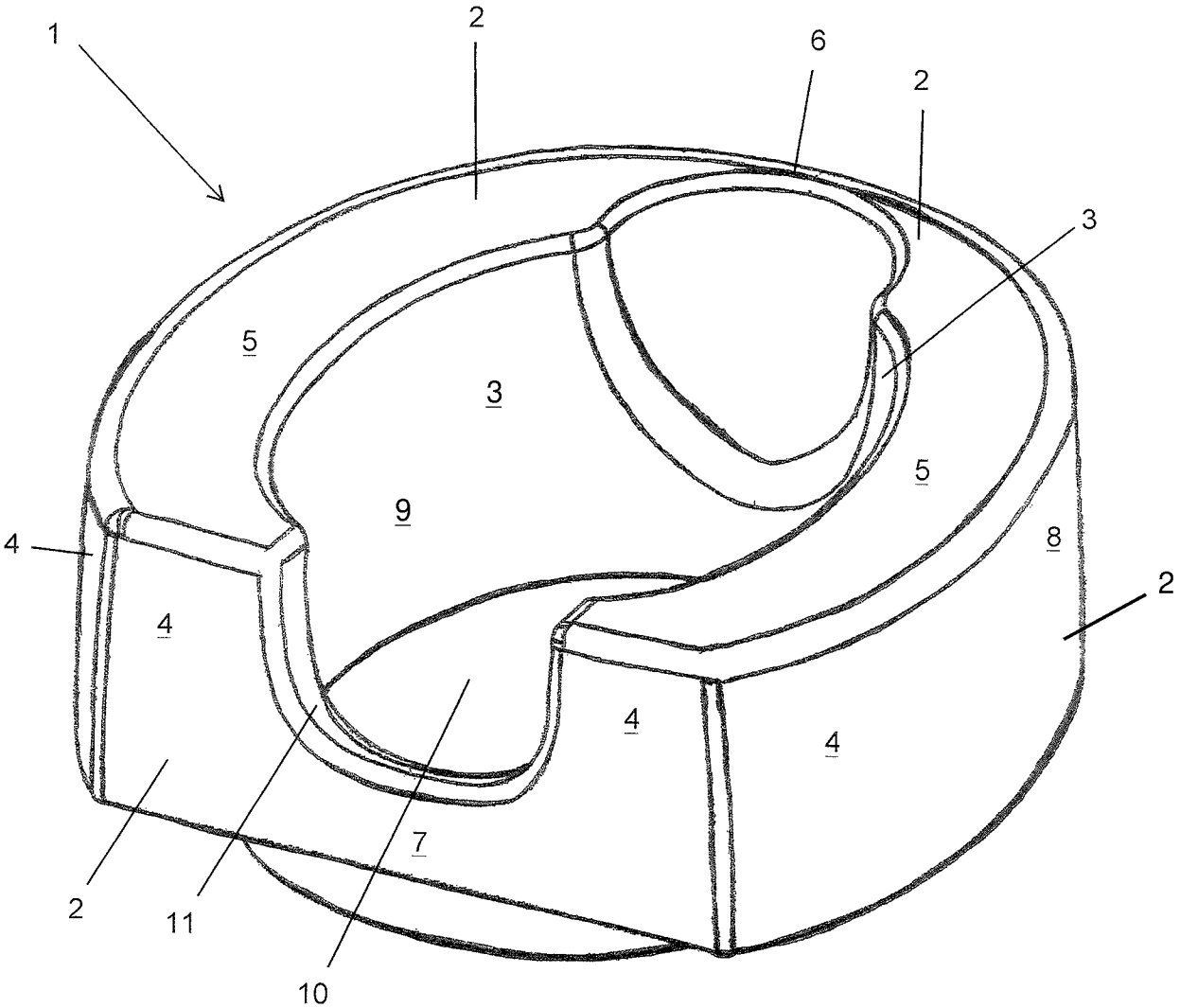
FIG. 1 illustrates a back and top side perspective view of one embodiment of the instant invention.

Reference will now be made in detail to embodiments of the invention, examples of which are illustrated in the accompanying drawings. Throughout the following detailed description, the same reference characters refer to the same or similar elements in all Figures. In this detailed description, reference is to a few embodiments of the instant invention, as illustrated in the accompanying and above-referenced drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

FIG. 1 comprises one embodiment of the instant invention that depicts a splash guard toilet riser apparatus 1 comprising a wall 2 having an inner perimeter surface wall 3, an outer perimeter surface wall 4, a top portion 5, a front portion 6, a back portion 7, a first side portion 8, a second side portion 9, and a void space 10. The first side portion 8 opposes the second side portion 9. The first side portion 8 and said second side portion 9 are disposed between the front portion 6 and the back portion 7. The void space 10 is disposed between the first side portion 8 and the second side portion 9 and the void space 10 is disposed between the front portion 6 and the back portion 7.

FIG. 1 depicts the back portion 7 that comprises a depressed elevation 11 of the wall 2. The front portion 6 comprises a concave indentation 12 into the inner perimeter surface wall 3.

Figure 2:
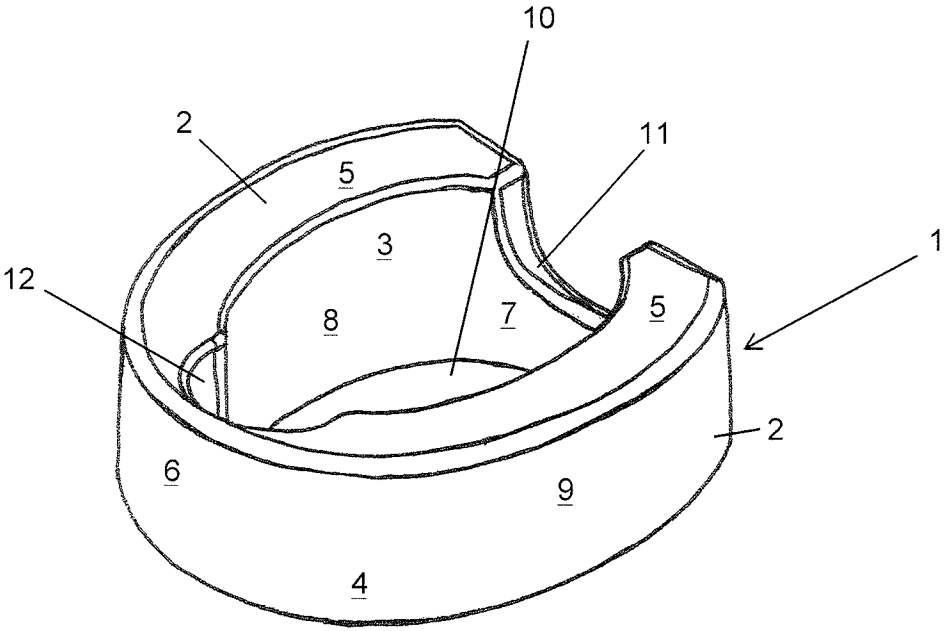
FIG. 2 illustrates a front and top side perspective view of one embodiment of the instant invention.

FIG. 2 comprises one embodiment of the instant invention that depicts the splash guard toilet riser apparatus 1 comprising the wall 2 having the inner perimeter surface wall 3, the outer perimeter surface wall 4, the top portion 5, the front portion 6, the back portion 7, the first side portion 8, the second side portion 9, and the void space 10. The first side portion 8 opposes the second side portion 9.

In FIG. 2, the first side portion 8 and the second side portion 9 are disposed between the front portion 6 and the back portion 7. The void space 10 is disposed between the first side portion 8 and the second side portion 9 and the void space 10 is disposed between the front portion 6 and the back portion 7.

Similar to FIG. 1, FIG. 2 depicts the back portion 7 that comprises the depressed elevation 11 of the wall 2. The front portion 6 comprises the concave indentation 12 into the inner perimeter surface wall 3.

Figure 3A:
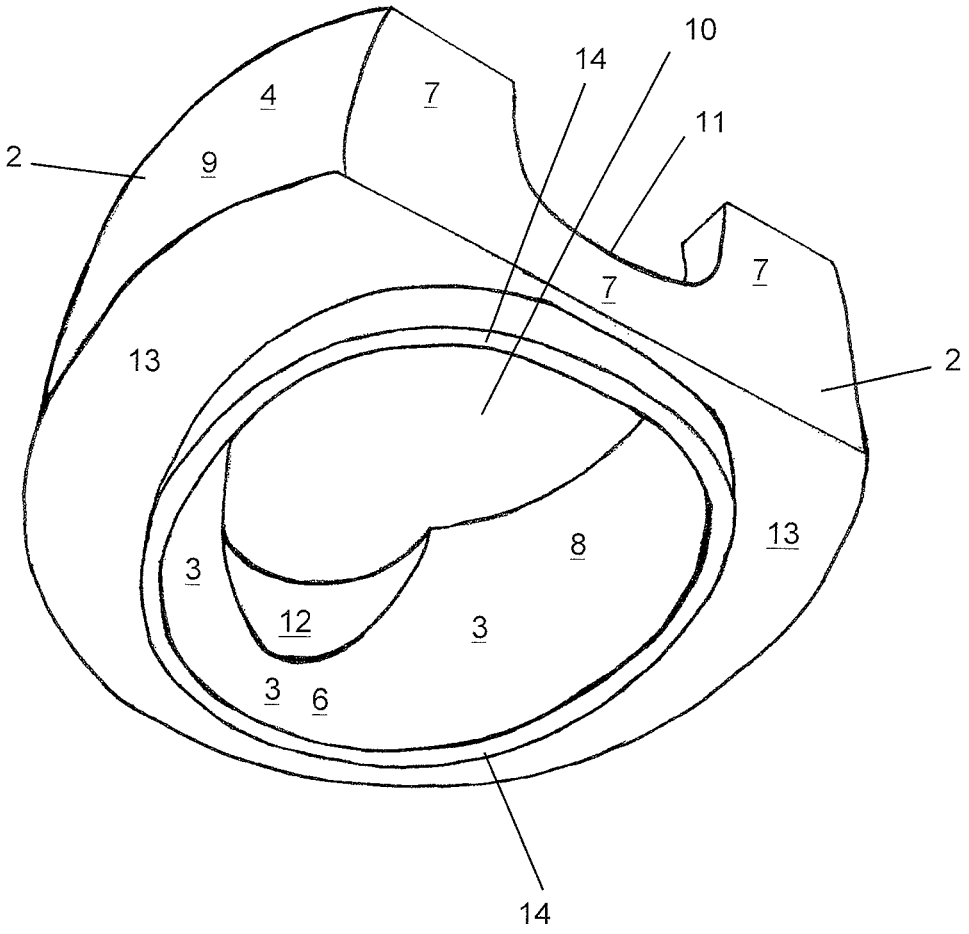
FIG. 3A and FIG. 3B illustrate a back and bottom side perspective view at slightly different angles of two embodiments of the instant invention, one not having a multiplicity of cavities and the other having a multiplicity of cavities.

FIG. 3A comprises another embodiment of the instant invention that depicts the splash guard toilet riser apparatus 1 comprising the wall 2 having the inner perimeter surface wall 3, the outer perimeter surface wall 4, the bottom portion 13, the front portion 6, the back portion 7, the first side portion 8, the second side portion 9, and the void space 10. The first side portion 8 opposes the second side portion 9. The first side portion 8 and the second side portion 9 are disposed between the front portion 6 and the back portion 7. The void space 10 is disposed between the first side portion 8 and the second side portion 9 and the void space 10 is disposed between the front portion 6 and the back portion 7.

FIG. 3A depicts the back portion that comprises the depressed elevation 11 of the wall 2. The front portion 6 comprises a concave indentation 12 into the inner perimeter surface wall 3. And FIG. 3A depicts the lip 14 attached to and extending below the bottom portion 13 of the wall 2.

Figure 3B:
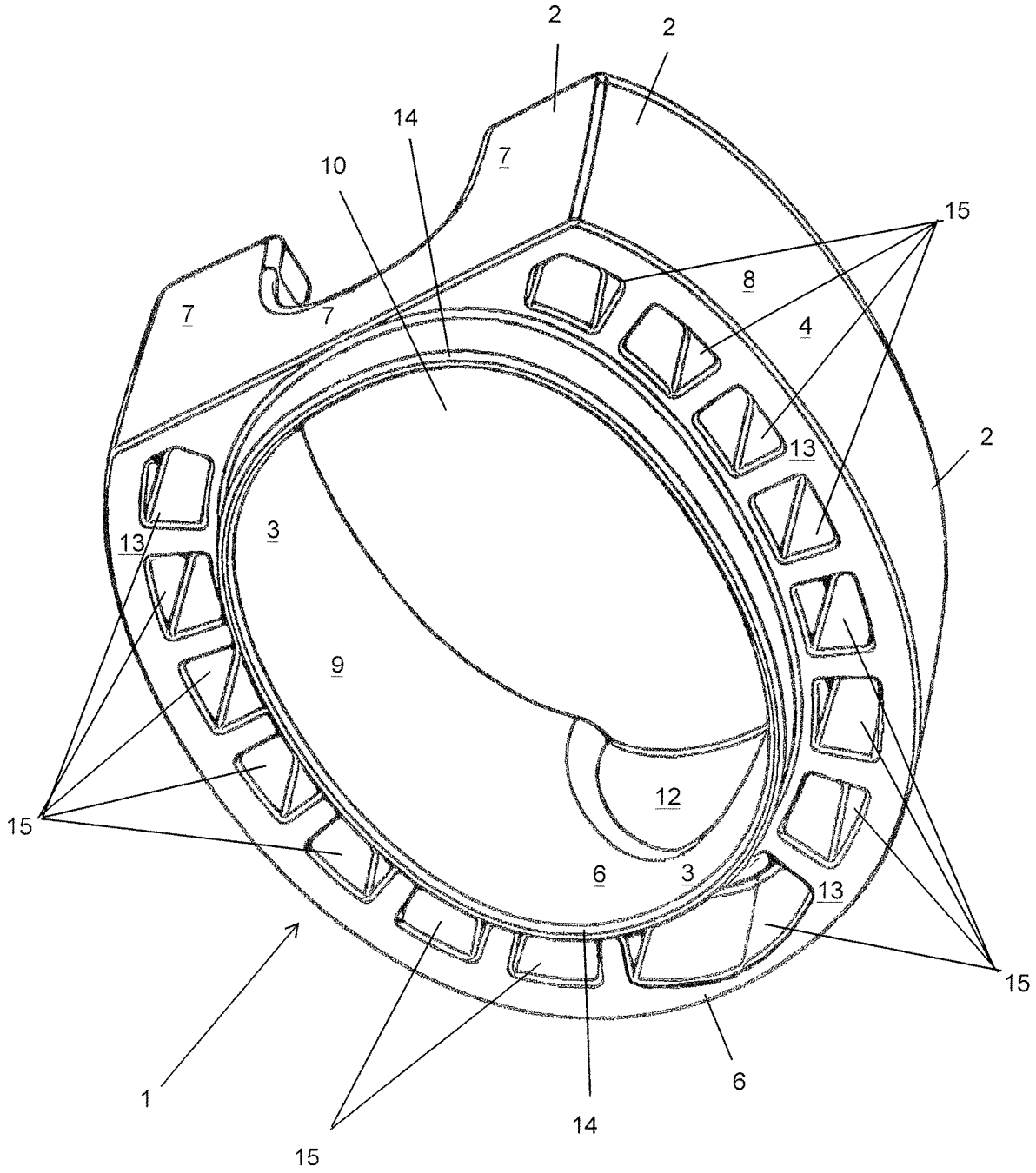

FIG. 3B depicts yet another embodiment of the instant invention, the splash guard toilet riser apparatus 1, from a slightly different angle than FIG. 3A. FIG. 3B comprises an embodiment similar to the embodiment depicted in FIG. 3A, except in the embodiment of FIG. 3B, there are depicted a multiplicity of cavities 15 which are disposed between the outer perimeter surface wall 4 and the inner perimeter surface wall 3. The multiplicity of cavities 15 extend from the bottom portion 13 of the wall 2 toward the top portion 5 (not depicted).

Figure 4:
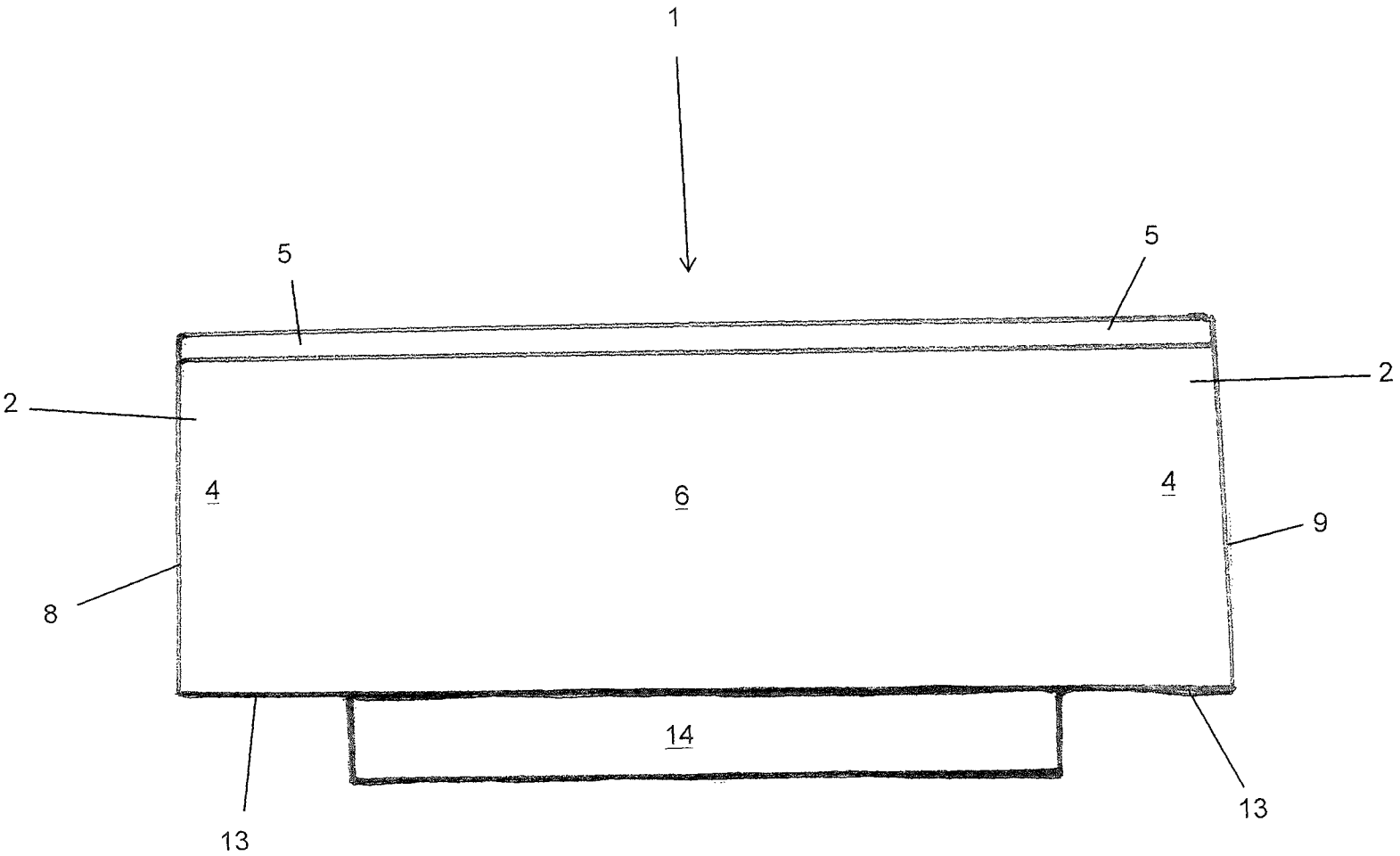
FIG. 4 illustrates a front planar view of one embodiment of the instant invention.

FIG. 4 depicts a front planar view of another embodiment of the instant invention showing the splash guard toilet riser apparatus 1 having the wall 2 having the outer perimeter surface wall 4, the front portion 6, the top portion 5, the first side portion 8, the second side portion 9, the bottom portion 13 and the lip 14. In actual use the lip 14 fits into the top and inner portion of a toilet bowl and the bottom portion 13 of the wall 2 sits atop the toilet.

Figure 5:
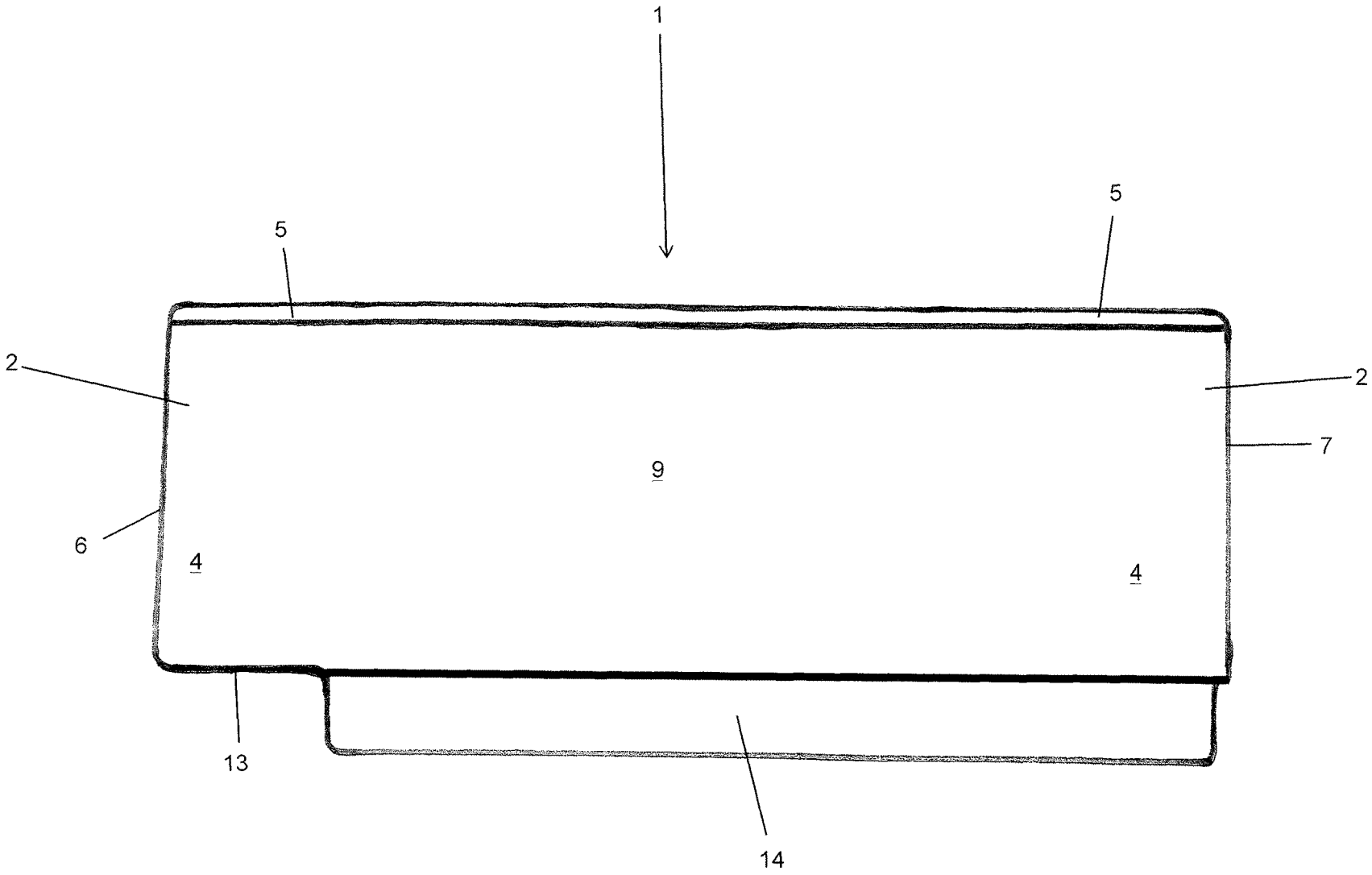
FIG. 5 illustrates a side planar view of one embodiment of the instant invention.

FIG. 5 depicts a side planar view of another embodiment of the instant invention showing the splash guard toilet riser apparatus 1 having the wall 2 having the outer perimeter surface wall 4, the front portion 6, the top portion 5, the back portion 7, the second side portion 9, the bottom portion 13 and the lip 14.

In one embodiment of the instant invention, the apparatus is comprised of foam. In other embodiments of the instant invention, the first side portion and the second side portion are comprised of a foam material. In many embodiments of the instant invention, the foam comprises a foam material selected from the group consisting of EVA foam 70-90 Shore A and EVA foam 40-60 Shore A.

The terms "certain embodiments", "an embodiment", "embodiment", "embodiments", "the embodiment", "the embodiments", "one or more embodiments", "some embodiments", and "one embodiment" mean one or more (but not all) embodiments unless expressly specified otherwise. The terms "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean "one or more", unless expressly specified otherwise.

While this invention has been described in terms of several embodiments, there are alterations, permutations, and equivalents, which fall within the scope of this invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A splash guard toilet riser apparatus comprising a wall having:

an inner perimeter surface wall; an outer perimeter surface wall; a top portion; a bottom portion; a front portion; a back portion; a first side portion; a second side portion; and a void space;

said first side portion opposes said second side portion, said first side portion and said second side portions are disposed between the front portion and the back portion;

said void space is disposed between the first side portion and the second side portion and said void space is disposed between the front portion and the back portion;

said front wall portion has a front wall height, said first side wall portion has a first side wall height, said second side wall portion has a second side wall height and said back wall portion has a back wall height; and said back wall height is less than said front wall height, said first wall height and said second wall height;

said front portion comprises a concave indentation into the inner perimeter surface wall.

2. The splash guard toilet riser apparatus of claim 1, wherein the riser apparatus comprises an EVA foam selected from the group consisting of 70-90 Shore A and 40-60 Shore A.

3. The splash guard toilet apparatus of claim 1, wherein the riser apparatus comprises EVA foam 70-90 Shore A.

4. The splash guard toilet apparatus of claim 1, wherein the riser apparatus comprises EVA foam 40-60 Shore A.

5. The splash guard toilet riser apparatus of claim 1, wherein the first side portion and the second side portion comprises a foam material.

6. The splash guard toilet riser apparatus of claim 5, wherein the first side portion and the second side portion comprises an EVA foam selected from the group consisting of 70-90 Shore A and 40-60 Shore A.

7. The splash guard toilet apparatus of claim 5, wherein the first side portion and the second side portion comprises EVA foam 70-90 Shore A.

8. The splash guard toilet apparatus of claim 5, wherein the wall further comprises a lip attached to and circumferentially extending below the bottom portion of the wall.

9. A splash guard toilet riser apparatus comprising a wall having:

an inner perimeter surface wall; an outer perimeter surface wall; a top portion; a bottom portion; a front portion; a back portion; a first side portion; a second side portion; and a void space;

said first side portion opposes said second side portion, said first side portion and said second side portions are disposed between the front portion and the back portion;

said void space is disposed between the first side portion and the second side portion and said void space is disposed between the front portion and the back portion; and said top portion of the wall comprises:

a front top portion disposed above the front portion of the wall;

a first side top portion disposed above the first side portion of the wall;

a second side top portion disposed above the second side portion of the wall;

and a back top portion disposed above the back portion of the wall, said back top portion is disposed lower than said first side top portion and lower than said second side top portion.

10. The splash guard toilet riser apparatus of claim 9, wherein said front portion comprises a concave indentation into the inner perimeter surface wall.

11. The splash guard toilet riser apparatus of claim 9, wherein the riser comprises an EVA foam selected from the group consisting of 70-90 Shore A and 40-60 Shore A.

12. The splash guard toilet apparatus of claim 9, wherein the riser comprises EVA foam 70-90 Shore A.

13. The splash guard toilet apparatus of claim of claim 9, wherein the riser comprises EVA foam 40-60 Shore A.

14. The splash guard toilet riser apparatus of claim 9, wherein the first side portion and the second side portion comprise a foam material.

15. The splash guard toilet riser apparatus of claim 14, wherein the wall further comprises a lip attached to and circumferentially extending below the bottom portion of the wall.

16. The splash guard toilet apparatus of claim 14, wherein the foam material comprises EVA foam 70-90 Shore A.

17. The splash guard toilet apparatus of claim 14, wherein the foam material comprises EVA foam 40-60 Shore A.

18. A splash guard toilet riser apparatus comprising a wall having:

an inner perimeter surface wall; an outer perimeter surface wall; a top portion; a bottom portion; a front portion; a back portion; a first side portion; a second side portion; and a void space;

said multiplicity of cavities disposed between the outer perimeter surface wall and the inner perimeter surface wall and said multiplicity of cavities extending from the bottom portion of the wall toward the top portion of the wall;

said first side portion opposes said second side portion, said first side portion and said second side portions are disposed between the front portion and the back portion;

said void space is disposed between the first side portion and the second side portion and said void space is disposed between the front portion and the back portion;

said front wall portion has a front wall height, said first side wall portion has a first side wall height, said second side wall portion has a second wall height and said back wall portion has a back wall height;

said back wall height is less than said front wall height, said first wall height and said second wall height said front portion further comprises a concave indentation into the inner perimeter surface wall.

19. The splash guard toilet apparatus of claim 18, wherein the wall further comprises a lip attached to and circumferentially extending below the bottom portion of the wall.

* * * * *